US007775957B2

(12) United States Patent
Totani

(10) Patent No.: US 7,775,957 B2
(45) Date of Patent: Aug. 17, 2010

(54) APPARATUS FOR MAKING PLASTIC BAGS

(75) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 0 days.

(21) Appl. No.: 12/358,927

(22) Filed: Jan. 23, 2009

(65) Prior Publication Data

US 2009/0175565 A1 Jul. 9, 2009

Related U.S. Application Data

(62) Division of application No. 10/484,595, filed as application No. PCT/JP03/09288 on Jul. 22, 2003, now Pat. No. 7,497,624.

(30) Foreign Application Priority Data

Jul. 24, 2002 (JP) ..... 2002-215559

(51) Int. Cl.
*B31B 1/60* (2006.01)

(52) U.S. Cl. ..... 493/210; 493/189; 493/194; 493/223; 493/231

(58) Field of Classification Search ..... 493/189, 493/194, 210, 223, 231; 383/120, 104, 107, 383/116
See application file for complete search history.

(56) References Cited

U.S. PATENT DOCUMENTS

| | | | | |
|---|---|---|---|---|
| 3,325,963 | A | 6/1967 | Walton | |
| 4,550,439 | A * | 10/1985 | Peppiatt et al. | 383/28 |
| 4,566,927 | A * | 1/1986 | Wood | 156/203 |
| 4,816,104 | A * | 3/1989 | Benoit | 156/204 |
| 5,275,491 | A * | 1/1994 | Kuge et al. | 383/61.2 |
| 5,364,189 | A * | 11/1994 | Kuge et al. | 383/61.2 |
| 6,261,000 | B1 | 7/2001 | Bois | |
| 6,398,412 | B2 * | 6/2002 | Wedi et al. | 383/211 |
| 6,425,847 | B1 * | 7/2002 | Broenstrup | 493/231 |
| 6,796,932 | B2 * | 9/2004 | Kuge et al. | 493/218 |
| 2001/0051008 | A1 | 12/2001 | Wedi et al. | |

FOREIGN PATENT DOCUMENTS

| | | | |
|---|---|---|---|
| JP | 5-97151 | A | 4/1993 |
| JP | 10-166477 | A | 6/1998 |
| JP | 2000-254984 | A | 9/2000 |
| JP | 2001-158057 | A | 6/2001 |
| JP | 2002-114232 | A | 4/2002 |

* cited by examiner

*Primary Examiner*—Hemant M Desai
(74) *Attorney, Agent, or Firm*—Hodgson Russ LLP

(57) ABSTRACT

A plastic bag including a pair of side gussets 1 is arranged to be free of leakage from one end portion of each of the side gussets. Each of the side gussets has opposite end portions one of which is folded obliquely along a folding line as it is folded into halves so that a triangular flap 13 can be formed by the end portion to be shaped into a triangle having a base formed by the folding line. The triangle has an apex formed by an intersection between one of the opposite end edges and the folded inner edge of each of the side gussets. The panels 2, the side gussets and the triangular flaps are heat sealed respectively along the opposite side edges 3 of panels.

1 Claim, 11 Drawing Sheets

APPARATUS FOR MAKING PLASTIC BAGS

CROSS-REFERENCE TO RELATED APPLICATIONS

The present application claims the benefit under 35 USC §120 as a divisional application of U.S. application Ser. No. 10/484,595 filed Aug. 16, 2004, issued as U.S. Pat. No. 7,497,624 on Mar. 3, 2009, which claims the benefit of priority of International Patent Application No. PCT/JP03/09288, filed Jul. 22, 2003, which claims priority of Japanese Patent Application No. 2002-215559, filed Jul. 24, 2002, the disclosures of which is incorporated herein by reference.

TECHNICAL FIELD

The invention relates to a plastic bag and a plastic bag making apparatus.

BACKGROUND

FIG. 18 illustrates a plastic bag of prior art. The plastic bag includes a pair of side gussets 1 which are incorporated into two superposed layers of panels 2 having opposite side edges 3. The side gussets 1 extend along the opposite side edges 3 of panels 2. In addition, each of the side gussets 1 is folded into halves and interposed between the layers of panels 2 to have a folded inner edge 4 and open outer edges 5, as shown in FIG. 19 and FIG. 20. The panels 2 and the side gussets 1 are heat sealed with each other along the opposite side edges 3 of panels 2 so that heat sealed portions 6 can be formed along the opposite side edges 3 of panels 2. The plastic bag can therefore be enlarged by the side gussets 1 to obtain an increased capacity.

Furthermore, it has been recently attempted to make a fastener 7 incorporated into the plastic bag including the side gussets 1. The fastener 7 may be called a zipper and has been used generally in itself. It includes a male member formed integrally with a tape and fitted into a female member which is also formed integrally with a tape. The male and female members extend along ones of the opposite end edges 8 of panels 2 to be interposed between the layers of panels 2. The layers of panels 2 are heat sealed with the tapes of male and female members. In addition, the layers of panels 2 are heat sealed with each other along the opposite end edges 8 and 9 thereof so that heat sealed portions 6 can be formed along the opposite end edges 8 and 9 of panels 2. The plastic bag can therefore be opened and closed by the fastener 7 after cutting the panels 2 along a cutting line 10 extending between the end edges 8 and the fastener 7.

In this case, the plastic bag is problematic in that each of the side gussets 1 includes opposite end portions one of which must be intervened against the fastener 7. It is therefore required to make the panels 2 heat sealed with the end portion of each of the side gussets 1 near the fastener 7 in such a way that the panels 2 and the side gusset 1 can be closed to each other by the heat sealed portion. However, it is difficult to accomplish such the step with a sealing strength enough to be free of leakage.

It is therefore an object of the invention to provide a plastic bag including a pair of side gussets, which is arranged to be free of leakage from one end portion of each of the side gussets.

DISCLOSURE OF THE INVENTION

According to the invention, the plastic bag includes a pair of side gussets which are incorporated into two superposed layers of panels having opposite side edges. The side gussets extend along the opposite side edges of panels. In addition, each of the side gussets is folded into halves and interposed between the layers of panels to have a folded inner edge, open outer edges and opposite end edges. Each of the side gussets has opposite end portions one of which is folded obliquely along a folding line as it is folded into halves so that a triangular flap can be formed by the end portion to be shaped into a triangle having a base formed by the folding line. The triangle has an apex formed by an intersection between one of the opposite end edges and the folded inner edge of each of the side gussets. The panels, the side gussets and the triangular flaps are heat sealed respectively along the opposite side edges of panels.

In a preferred embodiment, the folding line comprises a bisector which reaches intersections between the end edge and the open outer edges of each of the side gussets to bisect an angle between the end edge and the open outer edges of each of the side gussets. The triangular flap is shaped into an isosceles triangle having the base formed by the folding line.

The triangular flap may have a folded side along which the triangular flap and the side gusset are heat sealed with each other.

Hole or notch means may be formed in the triangular flap so that one of the layers of panels can be heat sealed with the side gusset through the hole or notch means.

Furthermore, according to the invention, an apparatus is arranged to make plastic bags. The apparatus includes feeding means of continuities of panels. Each of the continuities comprises panels continuous with each other widthwise thereof. The continuities are superposed into two layers and intermittently fed by the feeding means in a direction in which the panels are continuous with each other. The apparatus further includes supply means of side gussets. Each of the side gussets is previously folded into halves to have a folded side edge. The side gusset is then supplied to the continuity by the supply means whenever the continuities are intermittently fed so that the side gusset can be interposed between the layers of continuities. The side gusset extends perpendicularly to the feeding direction of continuities. The apparatus further includes folding means of side gussets. Each of the side gussets has opposite end portions one of which is folded obliquely along a folding line by the folding means as it is folded into halves after or before the side gusset is supplied to the continuity so that a triangular flap can be formed by the end portion to be shaped into a triangle having a base formed by the folding line. The triangle has an apex formed by an intersection between one of the opposite end edges and the folded side edge of each of the side gussets. The apparatus further includes heat seal means by which the continuities, the side gusset and the triangular flap are heat sealed respectively perpendicularly to the feeding direction of continuities so that heat sealed portions can be formed perpendicularly to the feeding direction of continuities whenever the continuities are intermittently fed. The apparatus further includes cutter means by which the continuities are cut along the heat sealed portions of continuities, side gusset and triangular flap whenever the continuities are intermittently fed, to make plastic bags each of which comprises two superposed layers of panels having opposite side edges, and a pair of side gussets extending along the opposite side edges of panels.

BEST MODE TO CARRY OUT THE INVENTION

Figure 1:
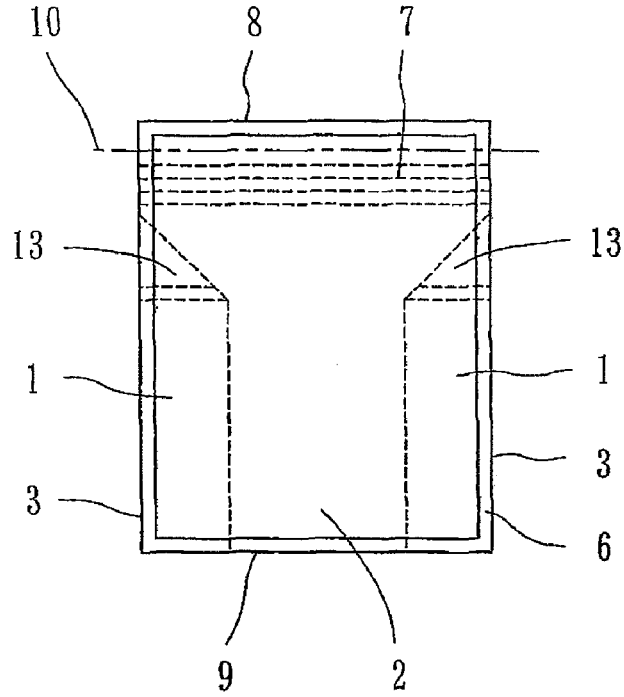
FIG. 1 is a plan view of a plastic bag according to the invention.
Figure 2:
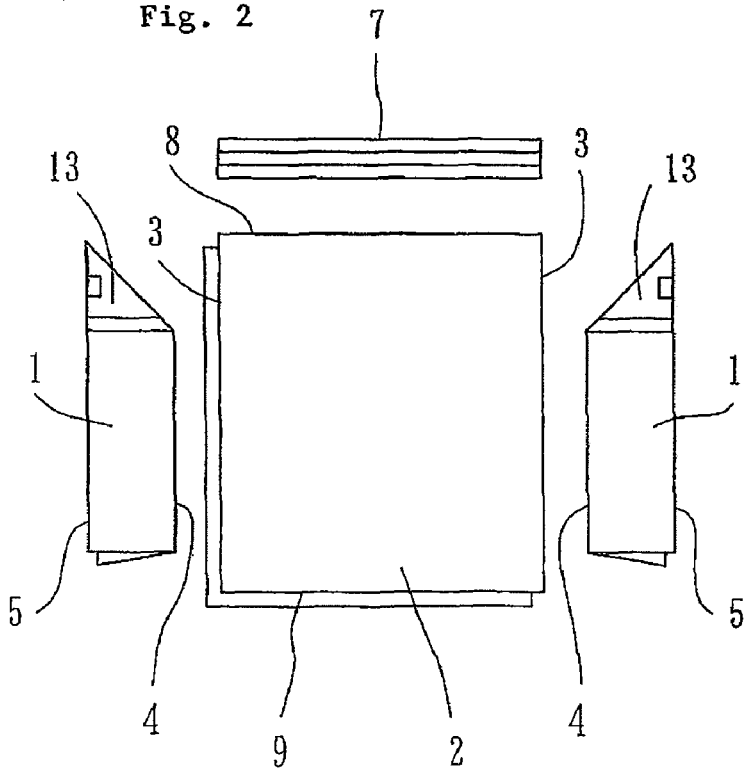
FIG. 2 is an explosive view of the plastic bag of FIG. 1.
Figure 18:
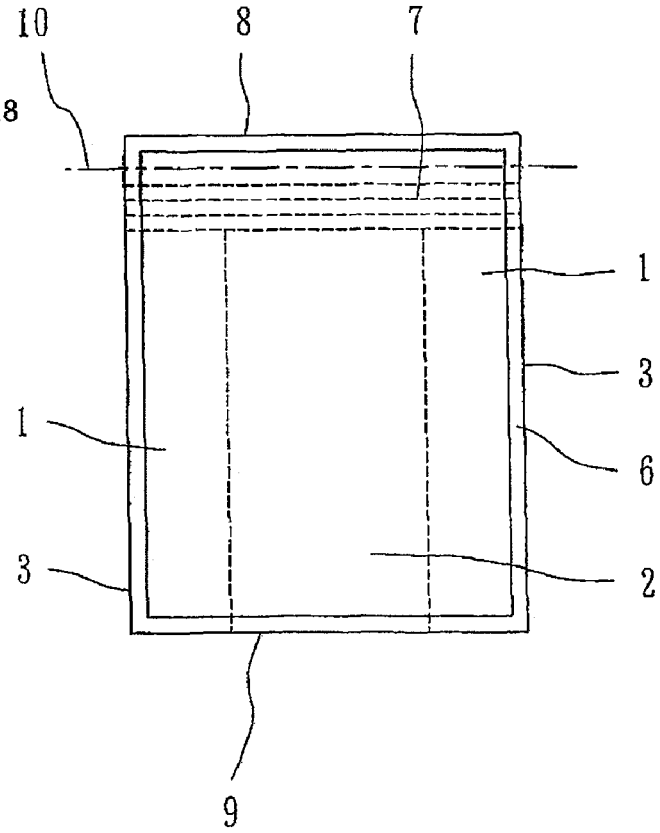
FIG. 18 is a plan view of a plastic bag of prior art.
Figure 19:
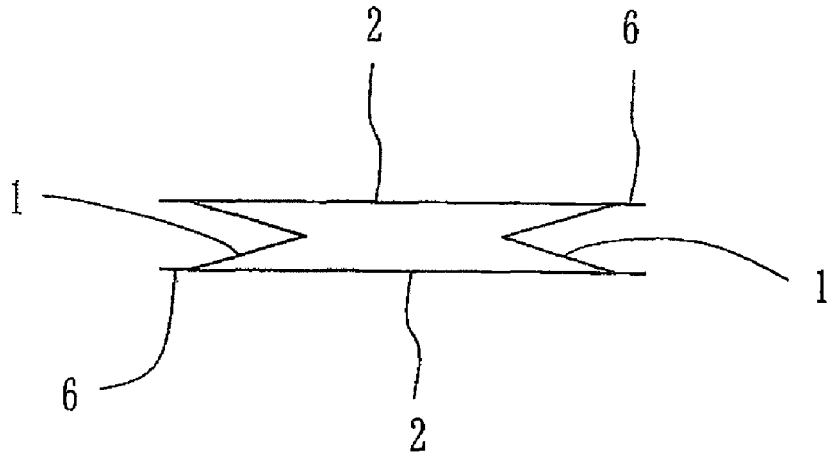
FIG. 19 is a sectional view of the plastic bag of FIG. 18.
Figure 20:
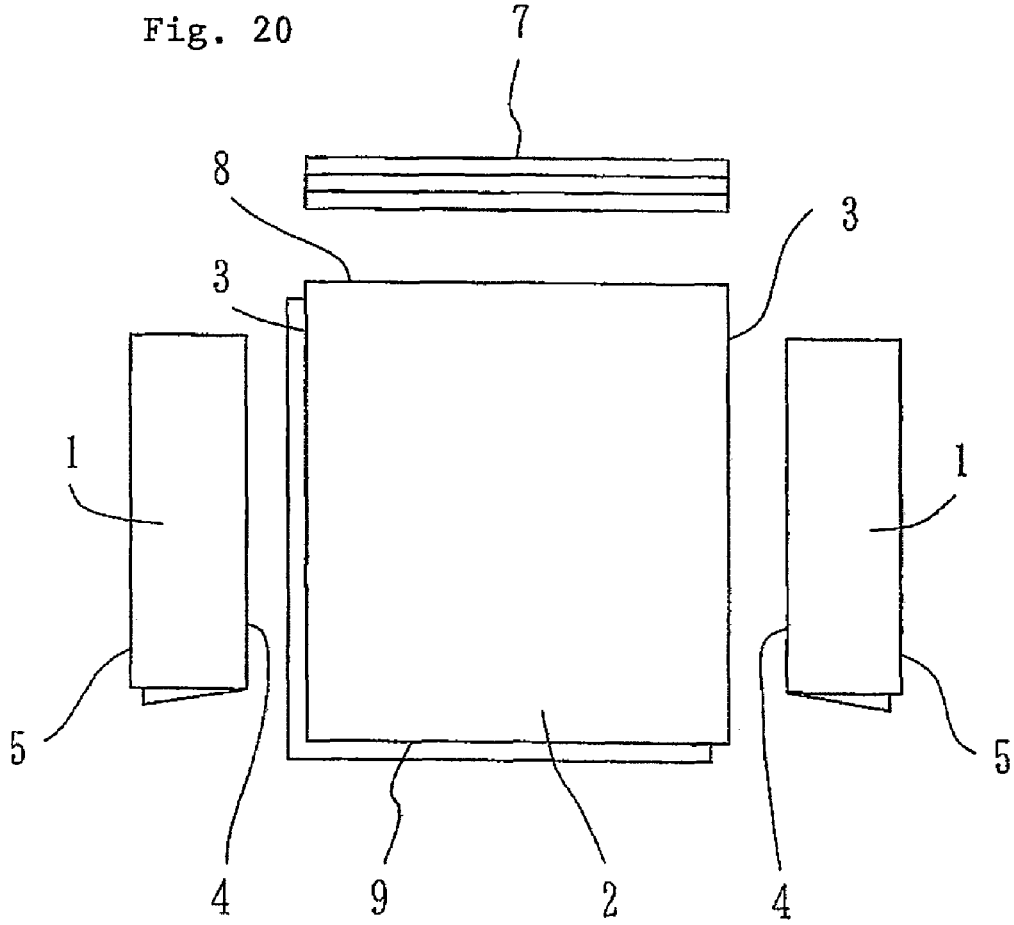
FIG. 20 is an explosive view of the plastic bag of FIG. 18.

FIG. 1 illustrates a plastic bag according to the invention. The plastic bag includes a pair of side gussets 1 which are incorporated into two superposed layers of panels 2 having opposite side edges 3, as in the case of plastic bag of FIG. 18. The side gussets 1 extend along the opposite side edges 3 of panels 2. In addition, each of the side gussets 1 is folded into halves and interposed between the layers of panels 2 to have a folded inner edge 4 and open outer edges 5, as shown in FIG. 2. The panels 2 and the side gussets 1 are heat sealed with each other along the opposite side edges 3 of panels 2 so that heat sealed portions 6 can be formed along the opposite side edges 3 of panels 2, as also in the case of plastic bag of FIG. 18. Furthermore, a fastener 7 is incorporated into the plastic bag. The fastener includes a male member formed integrally with a tape and fitted into a female member which is also formed integrally with a tape. The male and female members extend along ones of the opposite end edges 8 of panels 2 to be interposed between the layers of panels 2. The layers of panels 2 are heat sealed with the tapes of male and female members, as also in the case of plastic bag of FIG. 18. In addition, the layers of panels 2 are heat sealed with each other along the opposite end edges 8 and 9 thereof so that heat sealed portions 6 can be formed along the opposite end edges 8 and 9 of panels 2, as also in the case of plastic bag of FIG. 18. The plastic bag can therefore be opened and closed by the fastener 7 after cutting the panels 2 along a cutting lines 10 extending between the end edges 8 and the fastener 7.

Figure 3:
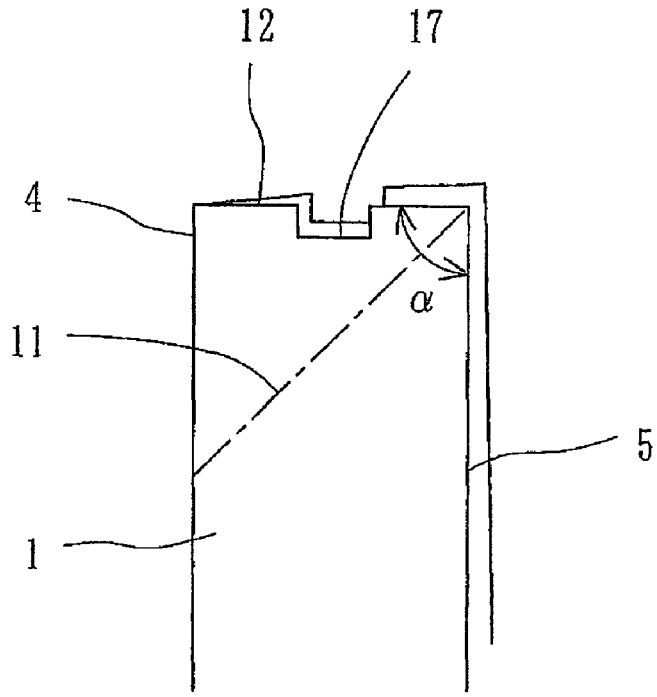
FIG. 3 is an explanatory view of the side gusset of FIG. 2 before being folded obliquely along a folding fine.
Figure 4:
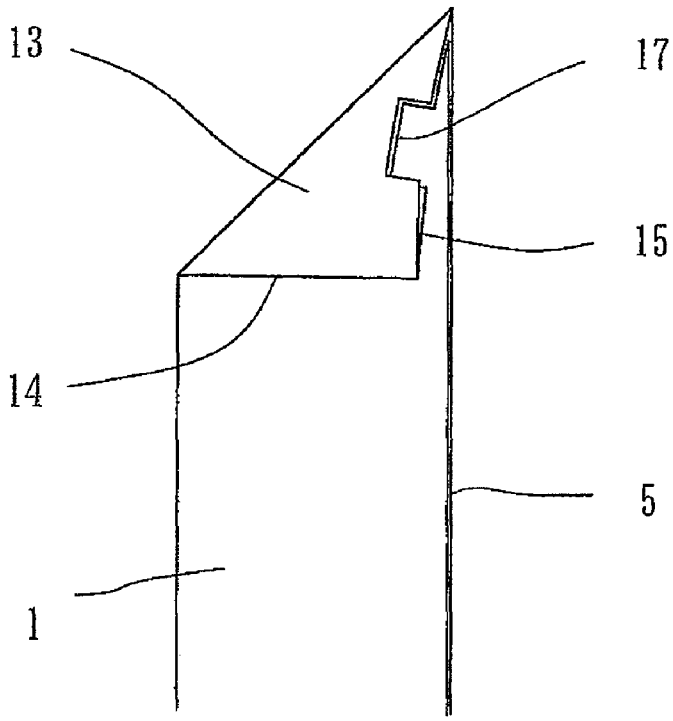
FIG. 4 is an explanatory view of the side gusset of FIG. 3 after being folded obliquely.

Furthermore, each of the side gussets 1 has opposite end portions one of which is folded obliquely along a folding line 11 near the fastener 7 as it is folded into halves so that a triangular flap 13 can be formed by the end portion to be shaped into a triangle having a base formed by the folding line 11, as shown in FIG. 3 and FIG. 4. The triangle has an apex formed by an intersection between one of the opposite end edges 12 and the folded inner edge 4 of each of the side gussets 1. The triangular flap 13 has therefore a folded side 14 and open sides 15. In addition, the panels 2, the side gussets 1 and the triangular flaps 13 are heat sealed respectively along the opposite side edges 3 of panels 2 so that heat sealed portions 6 can be formed along the opposite side edges 3 of panels 2.

Accordingly, one of the layers of panels 2 is heat sealed with the triangular flaps 13 along the opposite side edges 3 of panels 2, while the triangular flaps 13 are heat sealed with the side gussets 1 along the opposite side edges 3 of panels 2, when the panels 2, the side gussets 1 and the triangular flaps 13 are heat sealed respectively along the opposite side edges 3 of panels 2 after the end portion of each of the side gussets 1 being folded obliquely. In addition, the other layer of panel 2 is heat sealed with the side gussets 1 along the opposite side edges 3 of panels 2 on the opposite side to the triangular flaps 13. The panels 2 and the side gussets 1 can therefore be closed to each other by means of the heat sealed portions 6 with a sealing strength enough to be free of leakage from the end portion of each of the side gussets 1.

Figure 5:
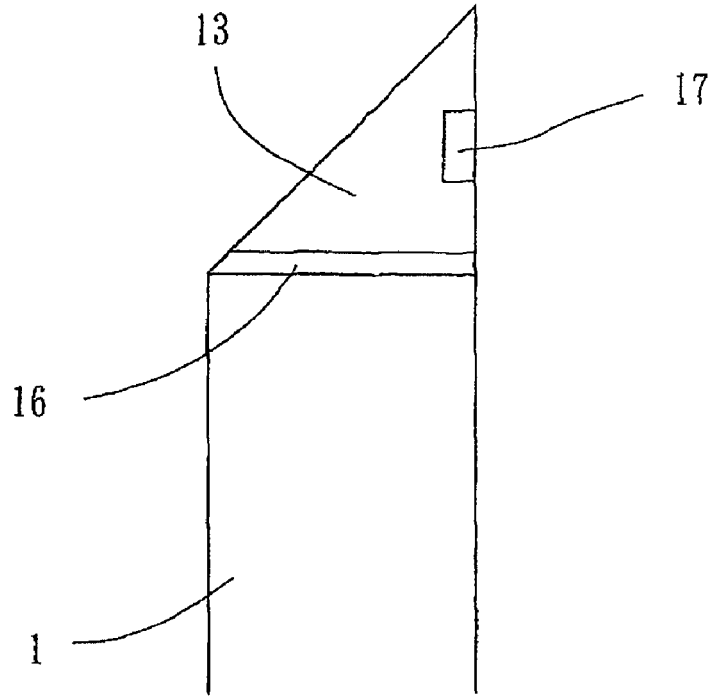
FIG. 5 is an explanatory view of the triangular flap of FIG. 4 after being heat sealed.

In the embodiment, the folding line 11 comprises a bisector which reaches intersections between the end edge 12 and the open outer edges 5 of each of side gussets 1 to bisect an angle $\alpha$ between the end edge 12 and the open outer edges 5 of each of the side gussets 1. The triangular flap 13 is therefore shaped into an isosceles triangle having the base formed by the folding line 11. The angle $\alpha$ is 90° so that the isosceles triangle must be a right one. The end edge 12 is therefore aligned with the open outer edges 5 of side gusset 1 when the end portion is folded obliquely along the folding line 11. In addition, the triangular flap 13 and the side gusset 1 are then heat sealed with each other along the folded side 14 of triangular flap 13 so that a heat sealed portion 16 can be formed along the folded side 14 of triangular flap 13, as shown in FIG. 5. It is then inserted between the layers of panels 2 to be interposed between them. The panels 2, the side gussets 1 and the triangular flaps 13 are then heat sealed respectively along the opposite side edges 3 of panels 2, as described above. Furthermore, hole or notch means 17 is formed in the triangular flap 13 so that one of the layers of panels 2 can be heat sealed with the side gusset 1 through the hole or notch means 17.

Accordingly, the end edge 12 can be kept being aligned with the open outer edges 5 of each of the side gussets 1 to be conveniently heat sealed therewith. In addition, the triangular flap 13 and the side gusset 1 can be closed to each other by means of the heat sealed portion 16. Furthermore, the triangular flap 13 includes the open hypotenuses 15 which can be closed to each other by the panel 2 and the side gusset 1 heat sealed with each other through the hole or notch means 17.

In the plastic bag, each of the panels 2 and the side gussets 1 comprises a laminated plastic film composed of a base material such as nylon and a sealant such as polyethylene or polypropylene which is laminated on the base material. The layers of panels 2 have inner surfaces formed by the sealant and outer surfaces formed by the base material. Each of the side gussets 1 has outer surfaces formed by the sealant and inner surfaces formed by the base material when being folded into halves. The triangular flap 13 has therefore outer surfaces formed by the sealant and inner surfaces formed by the base material.

It should therefore be recognized that the panels 2, the side gussets 1 and the triangular flaps 13 can be heat sealed respectively along the opposite side edges 3 of panels 2 when being sandwiched between and heated and pressurized by a pair of heat seal bars. In this step, one of the layers of panels 2 is heat sealed with the triangular flaps 13 by the sealant, while the triangular flaps 13 are heat sealed with the side gussets 1 by the sealant, in the positions of triangular flaps 13. The other layer of panel 2 is heat sealed with the side gussets 1 by the sealant on the opposite side to the triangular flaps 13. Each of the side gussets 1 has the inner surfaces not sealed with each other by reason that the inner surfaces are formed not by the sealant but by the base material. In addition, the layers of panels 2 are heat sealed with the side gussets 1 in positions other than the positions of triangular flaps 13 and heat sealed with each other and with the fastener 7 in positions other than the positions of side gussets 1.

Figure 6:
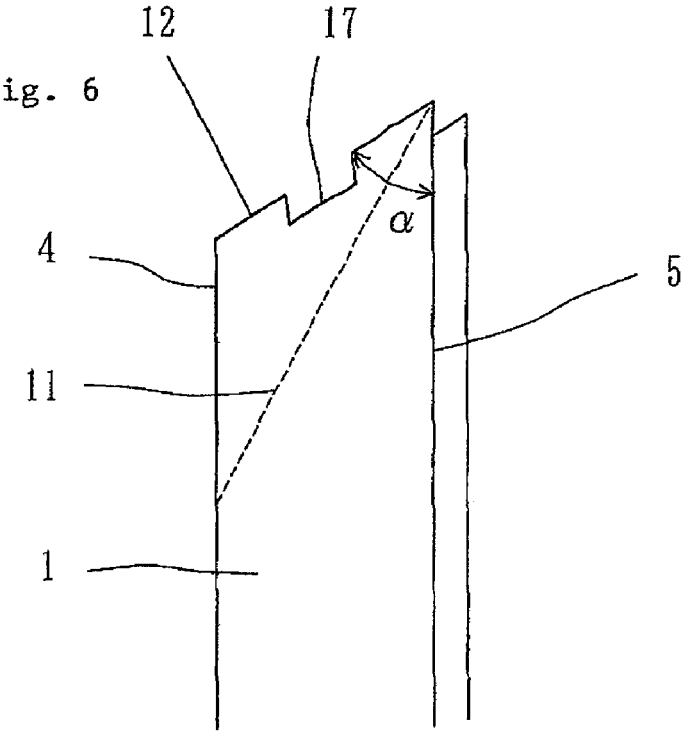
FIG. 6 is an explanatory view of other embodiment.
Figure 7:
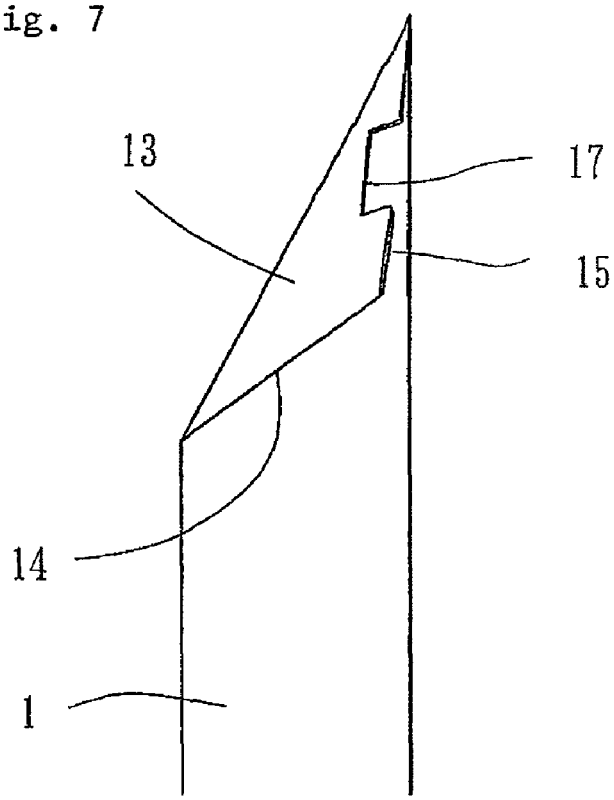
FIG. 7 is an explanatory view of the side gusset of FIG. 6 after being folded obliquely.
Figure 8:
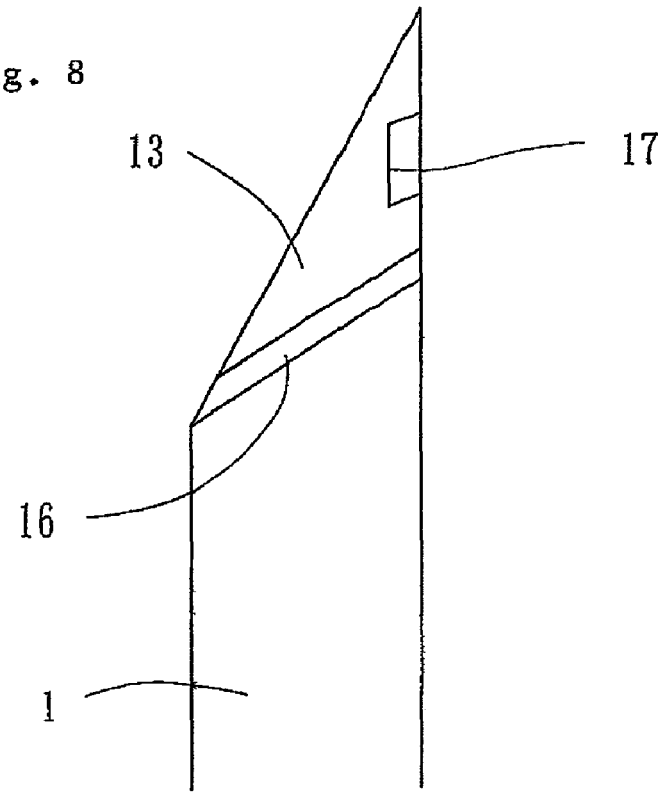
FIG. 8 is an explanatory view of the triangular flap of FIG. 7 after being heat sealed.

It is not always necessary that the triangular flap 13 is shaped into the right triangle by keeping the angle α being 90° between the end edge 12 and the open outer edges 5 of each of the side gussets 1. In other embodiment shown in FIG. 6, the side gusset 1 includes the end portion cut obliquely as it is folded into halves. The end portion is then folded obliquely along a folding line 11 as it is folded into halves, as shown in FIG. 7. The folding line 11 comprises a bisector bisecting an angle α between the end edge 12 and the open outer edges 5 of each of the side gussets 1. A triangular flap 13 is shaped into an isosceles having a base formed by the folding line 11. In this case, the angle α is not 90° but more or less than that. The triangular flap 13 is therefore not shaped into a right one. The end edge 12 is nevertheless aligned with the open outer edges 5 of each of the side gussets 1 when the end portion is folded obliquely along the folding line 11.

The triangular flap 13 and the side gusset 1 are then heat sealed with each other along the folded side 14 of triangular flap 13 so that a heat sealed portion 16 can be formed along the folded side 14. In addition, the panels 2, the side gussets 1 and the triangular flaps 13 are heat sealed respectively along the side edges 3 of panels 2 after the side gussets 1 are inserted between the layers of panels 2 to be interposed between them. The side gusset 1 has the end edge 12 which can be kept being aligned with the open outer edges 5 to be conveniently heat sealed therewith at the position of triangular flap 13.

Figure 9:
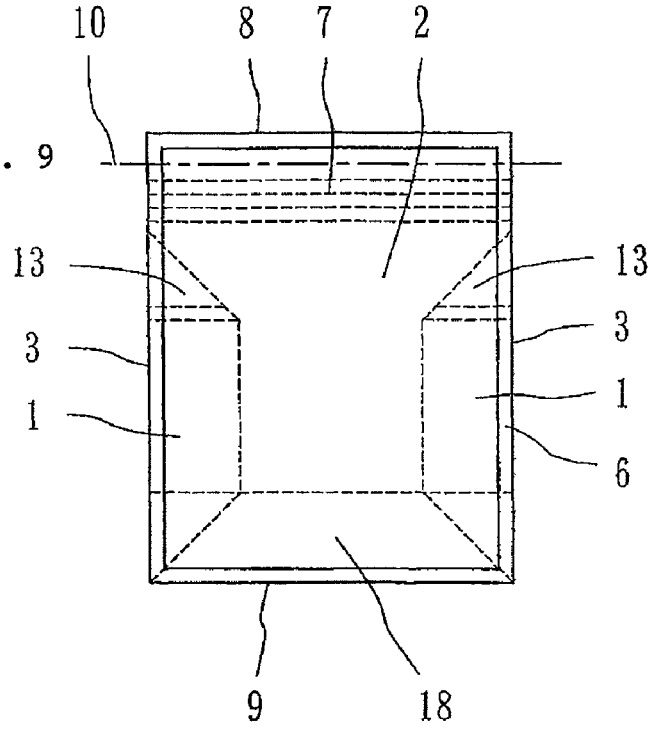
FIG. 9 is a plan view of other embodiment.

In other embodiment shown in FIG. 9, a bottom 18 is incorporated into a plastic bag including the side gussets 1 and the fastener 7. Each of the side gussets 1 includes the opposite end portions one of which is folded obliquely as it is folded into halves so that the triangular flap 13 can be formed by the end portion. In addition, the panels 2, the side gussets 1 and the triangular flaps 13 are heat sealed respectively along the opposite side edges 3 of panels 2, as in the case of plastic bag of FIG. 1.

Figure 10:
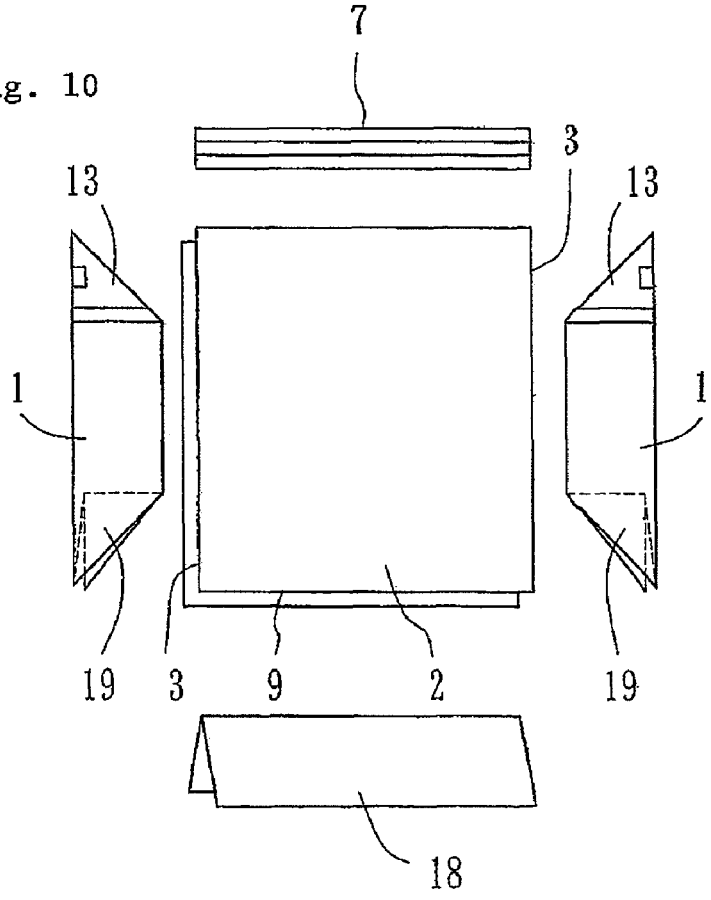
FIG. 10 is an explosive view of the plastic bag of FIG. 9.

Furthermore, each of the side gussets 1 includes the other end portion folded at an angle of 45° so that an auxiliary gusset 19 can be formed by the other end portion, folded into halves and interposed between the layers of side gusset 1, as shown in FIG. 10. The bottom 18 is folded into halves and interposed between the layers of panels 2 and between the layers of auxiliary gussets 19. The auxiliary gussets 19 and the bottom 18 are heat sealed with each other along the opposite side edges 3 of panels 2, while the panels 2 and the bottom 18 are heat sealed with each other along the other end edges 9 of panels 2. The plastic bag can therefore stably stand by the bottom 18 which can be flat when the plastic bag is enlarged.

In the plastic bag, the bottom 18 comprises a laminated plastic film composed of a base material such as nylon and a sealant such as polyethylene or polypropylene which is laminated on the base material, to have outer surfaces formed by the sealant and inner surfaces formed by the base material when being folded into halves. It should therefore be recognized that the auxiliary gussets 19 and the bottom 18 can be heat sealed with each other by the sealant when being sandwiched between and heated and pressurized by the heat seal bars. In addition, the panels 2 and the bottom 18 can be heat sealed with each other by the sealant when being sandwiched between and heated and pressurized by a pair of heat seal bars. The bottom 18 has the inner surfaces not sealed with each other by reason that the inner surfaces are formed not by the sealant but by the base material.

Figure 11:
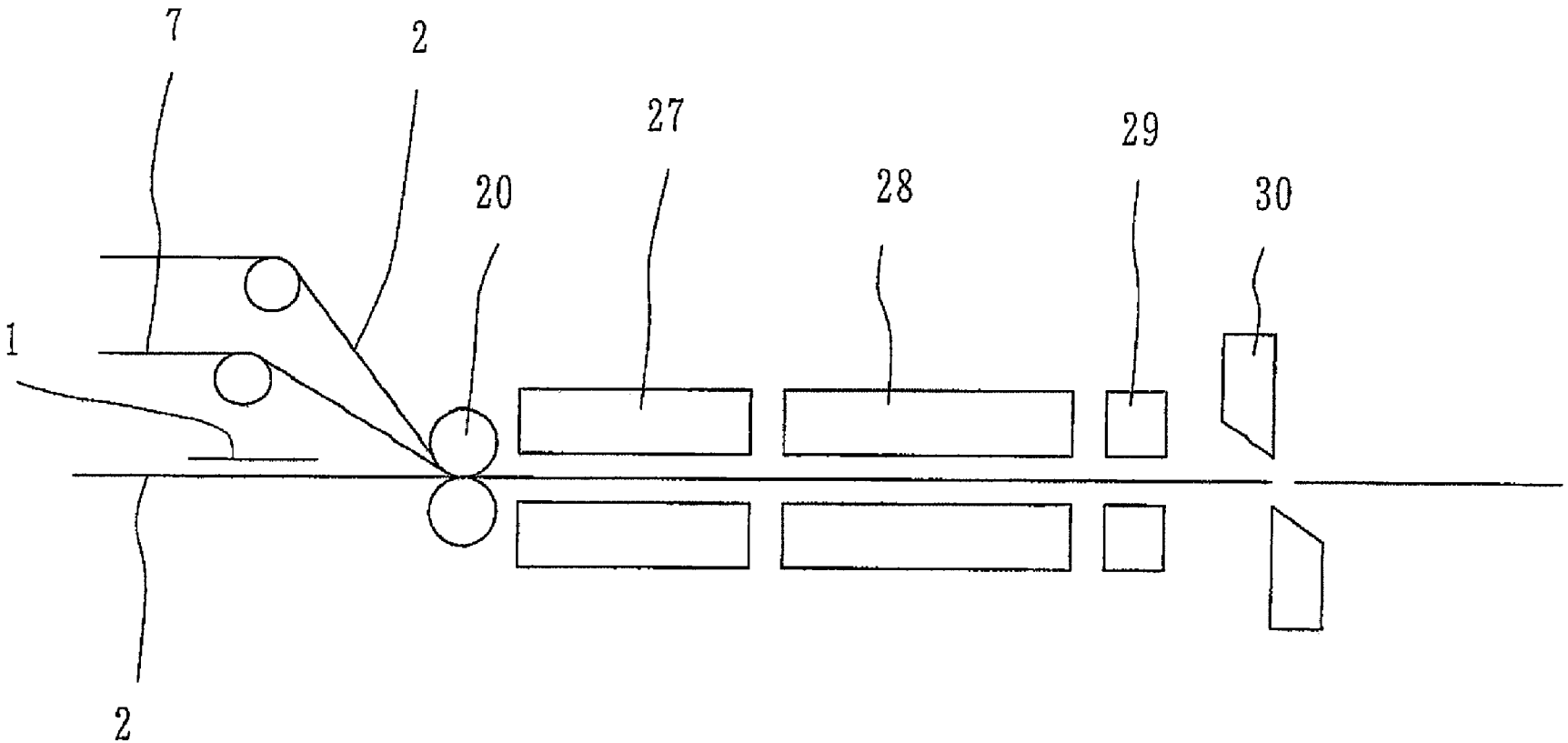
FIG. 11 is a side view of an apparatus for making plastic bags according to the invention.
Figure 12:
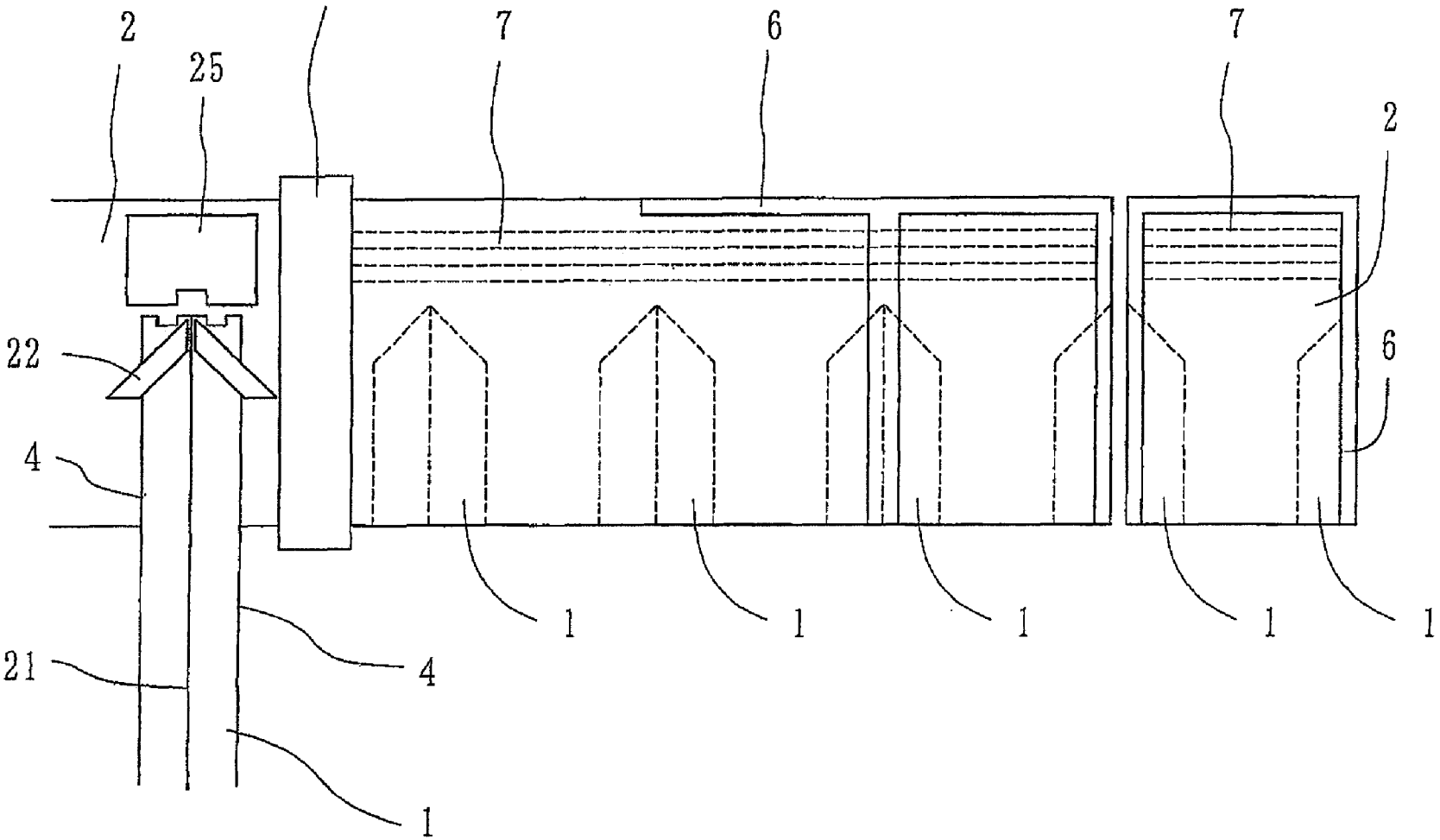
FIG. 12 is a plan view of the continuities of FIG. 11.

FIG. 11 illustrates an apparatus for making plastic bags of FIG. 1 or FIG. 9. The apparatus includes feeding means of continuities of panels 2. The feeding means comprises feeding rollers 20 between which the continuities 2 are directed. Each of the continuities 20 comprises panels continuous with each other widthwise thereof, as shown in FIG. 12. The continuities 2 are superposed into two layers and intermittently fed by the feeding rollers 20 in a direction in which the panels are continuous with each other.

The apparatus further includes supply means of side gussets 1. Each of the side gussets 1 is previously folded into halves to have a folded side edge 4. The side gusset 1 is then supplied to the continuity 2 by the supply means whenever the continuities 2 are intermittently fed so that the side gusset 1 can be interposed between the layers of continuities 2. The side gusset 1 extends perpendicularly to the feeding direction of continuities 2. In the embodiment, the side gusset is derived from continuity 1 having a double width. The continuity 1 is previously folded into halves on the opposite sides of the longitudinal centerline 21 to have folded side edges 4. In addition, the continuity 1 is directed perpendicularly to the feeding direction of one of the layers of continuities 2 before the continuities 2 are superposed into two layers. The continuity 1 is then intermittently fed by the supply means such as conveyor belts to be supplied to and put on the continuity 2 whenever the continuities 2 are intermittently fed. It should be noted that the continuity 1 comprises side gussets continuous with each other two by two and longitudinally thereof. It should also be noted that the continuity 1 is intermittently fed by the supply means in a direction in which the side gussets are continuous with each other.

Figure 13:
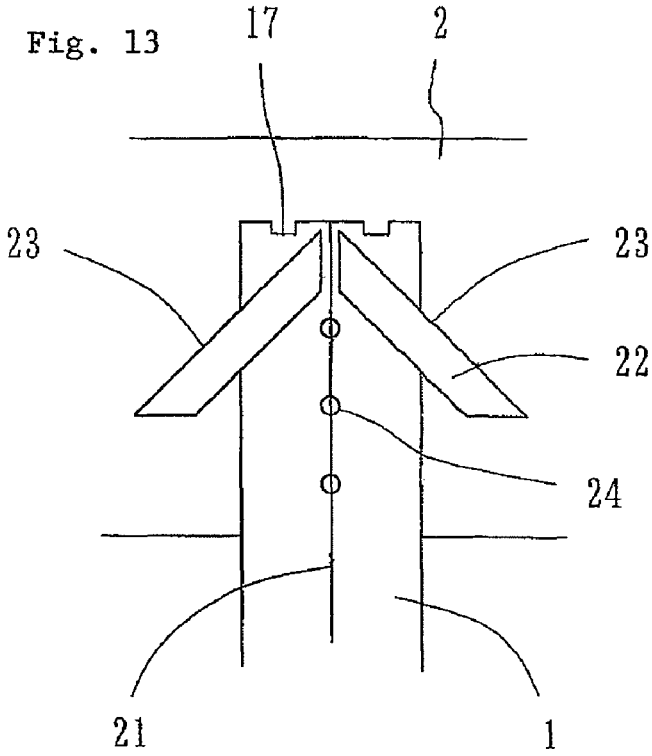
FIG. 13 is an explanatory view illustrating a process of making the side gusset of FIG. 12.
Figure 14:
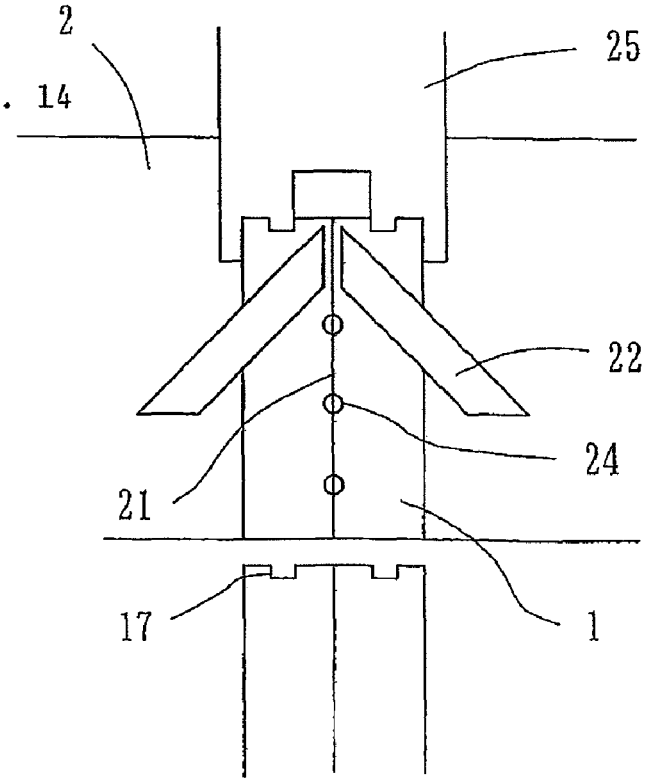
FIG. 14 is an explanatory view illustrating a process of making the side gusset next to that of FIG. 13.

The continuity 1 includes hole or notch means 17 formed at the end edge thereof, as shown in FIG. 13. In addition, the continuity 1 is spot sealed with the continuity 2 to be provisionally attached thereto by a heat seal or ultrasonic seal apparatus after being supplied so that spot sealed portions 24 can be formed on the centerline 21 of continuity 1. A triangular plate 22 is then put on the continuity 1 so that the continuity 1 can be held by the plate 22. The plate 22 is split into two pieces along the centerline 21 of continuity 1 to have oblique sides 23 and a center slit. The continuity 1 is then cut by a cutter so that two side gussets 1 can be separated and derived from the continuity to have opposite end edges, as shown in FIG. 14. Hole or notch means 17 is again formed at the end edge of continuity 1 at the same time or after the continuity 1 is cut. The hole or notch means 17 may be previously formed. In this case, the continuity 1 is then cut at the position of hole or notch means 17.

Figure 15:
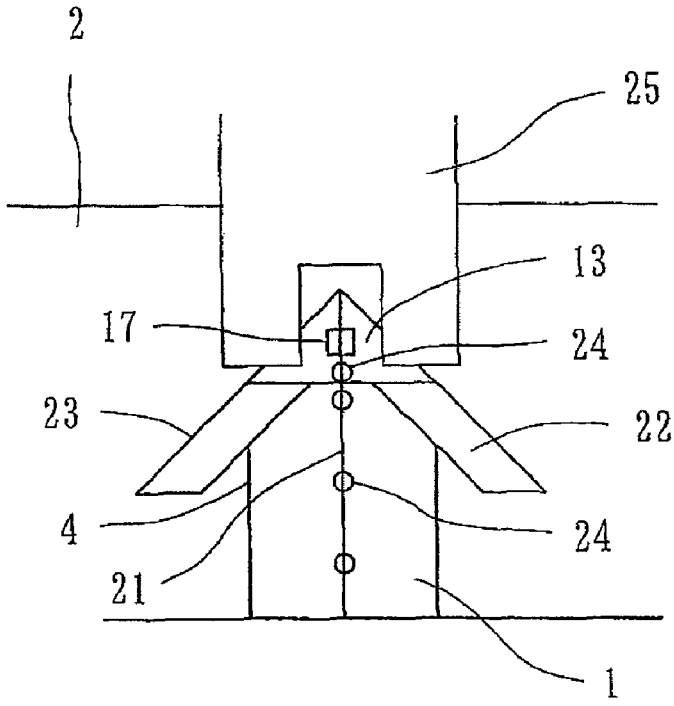
FIG. 15 is an explanatory view illustrating a process of making the side gusset next to that of FIG. 14.

The apparatus further includes folding means of side gussets. The folding means comprises a spatula 25 which is moved perpendicularly to the feeding direction of continuity 2 to be inserted between the side gussets 1 and the continuity 2. Each of the side gussets 1 has opposite end portions one of which is folded obliquely along the oblique side 23 of plate 22 by the spatula 25 moved perpendicularly to the feeding direction, as shown in FIG. 15. It should therefore be recognized that the end portion is folded obliquely along a folding line 11 by the spatula 25 as it is folded into halves after the side gusset 1 is supplied to the continuity 2 so that a triangular flap 13 can be formed by the end portion to be shaped into a triangle having a base formed by the folding line 11. The triangle has an apex formed by an intersection between one of the opposite end edges and the folded side edge 4 of each of the side gussets 1. The triangular flaps 13 are then spot sealed with the side gussets 1 to be provisionally attached thereto by a heat seal or ultrasonic seal apparatus so that spot sealed portions 24 can be formed on the longitudinal centerline 21 of side gussets 1. The plate 22 is then moved perpendicularly to the feeding direction of continuity 2 of panel to be extracted from the triangular flaps 13 and returned into the original position. The spatula 25 is also moved and returned into the original position.

Figure 16:
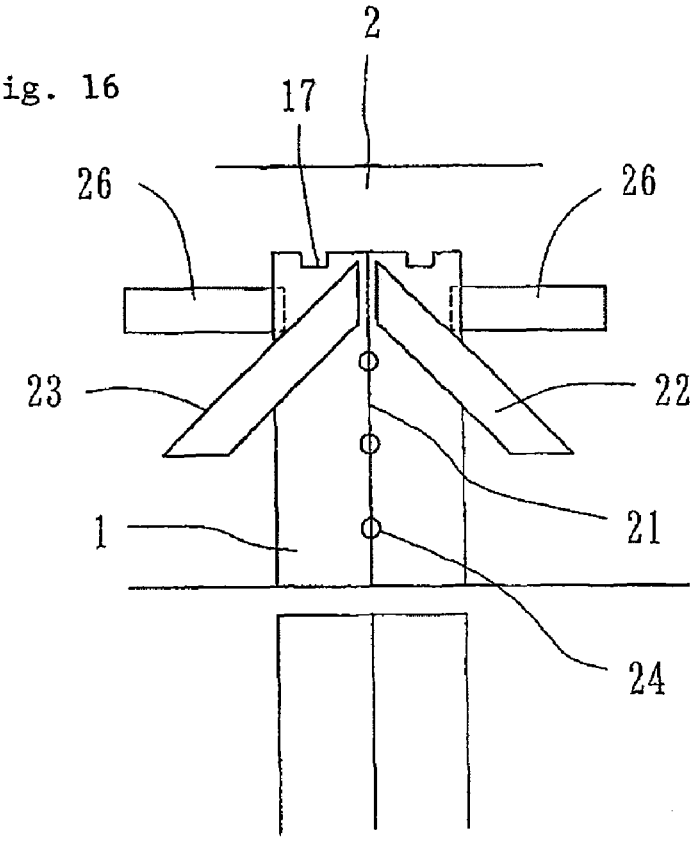
FIG. 16 is an explanatory view of other embodiment.
Figure 17:
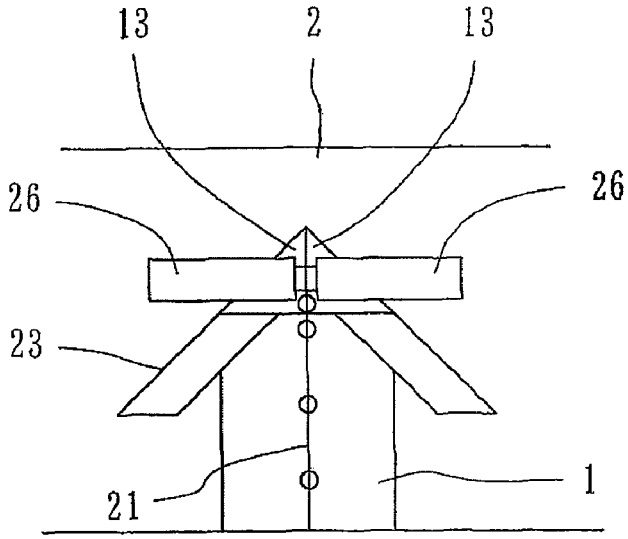
FIG. 17 is an explanatory view illustrating a process of making the side gusset next to that of FIG. 16.

Spatulas 26 may be moved parallel to the feeding direction of continuity 2 to be inserted between the side gussets 1 and the continuity 2. In this case, each of the side gussets 1 has the end portion which is obliquely folded along the oblique side 23 of plate 22 by the spatulas 26, as shown in FIG. 16 and FIG. 17. In addition, the triangular flaps 13 are spot sealed with the side gussets 1 to be provisionally attached thereto by a heat seal or ultrasonic seal apparatus. The plate 22 is then extracted from the triangular flaps 13 and returned into the original position. The spatulas 26 are also moved and returned into the original positions.

The triangular flaps 13 and the side gussets 1 are then heat sealed with each other along the folded sides 14 of triangular flaps 13 by a heat seal apparatus so that the heat sealed portions 16 can be formed along the folded side 14.

It is not always necessary that each of the side gussets 1 has the end portion which is folded obliquely as it is folded into halves after the side gusset 1 is supplied. The end portion may be folded obliquely as it is folded into halves at a side gusset making station, after the hole or notch means 17 is formed in the end edge of side gusset 1 and before the side gusset 1 is supplied. The triangular flap 13 and the side gusset 1 may also be heat sealed along the folded side 14. The side gusset 1 is then fed by the supply means to be supplied to and put on the continuity 2. The side gusset 1 is then provisionally attached to the continuity 2 by the heat seal or ultrasonic seal apparatus.

The continuities 2 are then superposed into two layers at the position of feeding rollers 20 by being intermittently fed so that the side gussets 1 can be interposed between the layers of continuities 2. The side gussets 1 extend perpendicularly to the feeding direction of continuities 2. At the same time, continuity 7 is directed to and inserted between the layers of continuities 2. The continuity 7 comprises fasteners continuous with each other longitudinally thereof.

The apparatus further includes heat seal means comprising a heat seal apparatus 27 by which the continuities 2 and the continuity 7 are heat sealed with each other whenever the continuities 2 are intermittently fed. The apparatus further includes heat seal means comprising a heat seal apparatus 28 by which the layers of continuities 2 are heat sealed with each other along ones of the opposite end edges of continuities 2 so that the heat sealed portion 6 can be formed along the end edges. In addition, the apparatus includes heat seal means comprising a heat seal apparatus 29 by which the continuities 2, the side gussets 1 and the triangular flaps 13 are heat sealed respectively perpendicularly to the feeding direction of continuities 2 and along the longitudinal centerline 21 of side gussets 1 whenever the continuities 2 are intermittently fed so that the heat sealed portions 6 can be formed perpendicularly to the feeding direction of continuities 2 and along the longitudinal centerline 21.

The apparatus further includes cutter means comprising a cutter 30 by which the continuities 2, the side gussets 1 and the continuity 7 are cut along the longitudinal centerline 21 of side gussets 2 and the heat sealed portions 6 of continuities 2, side gussets 1 and triangular flaps 13 whenever the continuities 2 are intermittently fed, to make plastic bags each of which comprises two superposed layers of panels 2 having opposite side edges 3, and a pair of side gussets 1 extending along the opposite side edges 3 of panels 2.

The cutter 30 may be actuated two times so that the continuities 2, the side gussets 1 and the continuity 7 can be cut on the opposite sides of the longitudinal centerline 21 of side gussets 1 by the cutter 30. The cutter 30 may include two THOMSON blades spaced from each other at a small distance and parallel to the feeding direction of continuities 2 so that the continuities 2, the side gussets 1 and the continuity 7 can be cut on the opposite sides of longitudinal centerline 21 of side gussets 1. Other blades may be spaced from each other at a small distance so that the continuities 2, the side gussets 1 and the continuity 7 can be cut on the opposite sides of longitudinal centerline 21 of side gussets 1.

The apparatus can therefore make the plastic bags of FIG. 1.

In connection with the plastic bag of FIG. 9, the side gussets 1 may be folded by appropriate means so that the auxiliary gussets 19 can be formed by the other end portions of side gussets 1 in the apparatus of FIG. 11. In addition, a bottom 18 may be previously folded into halves and then inserted and interposed between the layers of continuities 2 and the layers of auxiliary gussets 19. The auxiliary gussets 19 and the bottom 18 are then heat sealed with each other along the opposite side edges 3 of panels 2. In addition, the panels 2 and the bottom 18 are heat sealed along the other end edges 9 of panels 2, to make plastic bags of FIG. 9. The auxiliary gussets 19 may be formed by the other end portions of side gussets 1 at the side gusset making station when the hole or notch means 17 is formed and the triangular flap 13 is formed and heat sealed. The side gussets 1 are then supplied to and put on the continuity 2.

According to the invention, the triangular flaps 13 are formed by the end portions of side gussets 1 folded obliquely, described above. The panels 2, the side gussets 1 and the triangular flaps 13 are then heat sealed respectively along the opposite side edges 3 of panels 2. The panels 2 and the side gussets 1 can therefore be closed to each other with a sealing strength enough to be free of leakage from the end portion of each of the side gussets 1.

The invention claimed is:

1. An apparatus for making plastic bags comprising:

feeding means of continuities of panels, each of the continuities comprising panels continuous with each other widthwise thereof, the continuities being superposed into two layers and intermittently fed by the feeding means in a direction in which the panels are continuous with each other;

supply means of side gussets, each of the side gussets being previously folded into halves to have a folded side edge, the side gusset being then supplied to the continuity by the supply means whenever the continuities are intermittently fed so that the side gusset can be interposed between the layers of continuities, the side gusset extending perpendicularly to the feeding direction of continuities;

folding means of side gussets, each of the side gussets having opposite end portions one of which is folded obliquely along a folding line by the folding means as it is folded into halves after or before the side gusset is supplied to the continuity so that a triangular flap can be formed by the end portion to be shaped into a triangle having a base formed by the folding line, the triangle having an apex formed by an intersection between one of the opposite end edges and the folded side edge of each of the side gussets;

heat seal means by which the continuities, the side gusset and the triangular flap are heat sealed respectively perpendicularly to the feeding direction of continuities so that heat sealed portions can be formed perpendicularly to the feeding direction of continuities whenever the continuities are intermittently fed; and cutter means by which the continuities are cut along the heat sealed portions of continuities, side gusset and triangular flap whenever the continuities are intermittently fed, to make plastic bags of each which comprises two superposed layers of panels having opposite side edges, and a pair of side gussets extending along the opposite side edges of panels, each of the panels and the side gussets comprising a laminated plastic film composed of a base material and a sealant which is laminated on the base material, the layers of panels having inner surfaces formed by the sealant and outer surfaces formed by the base material, each of the side gussets having outer surfaces formed by the sealant and inner surfaces formed by the base material when being folded into halves, the triangular flaps having outer surfaces formed by the sealant and inner surfaces formed by the base material, the heat seal means making the panels and the side gussets heat sealed with each other by the sealant along the opposite side edges of panels so that heat sealed portions can be formed along the opposite side edges of the panels, the triangular flaps having open sides extending along the opposite side edges of panels to be positioned in the heat sealed portions, the heat seal means making one of the layers of panels heat sealed with the triangular flaps by the sealant along the opposite side edges of panels and the triangular flaps heat sealed with the side gussets by the sealant.

* * * * *